US007635206B2

(12) United States Patent
Huang

(10) Patent No.: US 7,635,206 B2
(45) Date of Patent: Dec. 22, 2009

(54) LIGHT EMITTING DIODE LIGHTING DEVICE HAVING A LENS CONNECTED TO A HOOD

(75) Inventor: Jack Huang, Tucheng City (TW)

(73) Assignee: Yujing Technology Co., Ltd., Taipei Hsien (TW)

( * ) Notice: Subject to any disclaimer, the term of this patent is extended or adjusted under 35 U.S.C. 154(b) by 190 days.

(21) Appl. No.: 12/006,353

(22) Filed: Jan. 2, 2008

(65) Prior Publication Data

US 2009/0168428 A1 Jul. 2, 2009

(51) Int. Cl.
*F21V 7/00* (2006.01)

(52) U.S. Cl. ..... 362/296.01; 362/249.02; 362/294

(58) Field of Classification Search ..... 362/294, 362/296.01, 297, 303, 310, 800, 253, 257, 362/362, 539, 538, 545, 311.01, 516, 249.02
See application file for complete search history.

(56) References Cited

U.S. PATENT DOCUMENTS 6,945,672 B2 * 9/2005 Du et al. ..... 362/241
6,948,836 B2 * 9/2005 Ishida et al. ..... 362/516
7,341,366 B2 * 3/2008 Iwasaki ..... 362/538

* cited by examiner

*Primary Examiner*—GunYoung T Lee
(74) *Attorney, Agent, or Firm*—Jackson Walker, LLP

(57) ABSTRACT

A light emitting diode (LED) lighting device has a base, a hood, an LED module, a light gathering element and a lens. The base has a container having an inner bottom. The inner bottom comprises a parallel surface and a mounting surface being connected to the parallel surface at an included angle. The hood has a reflective inner surface and is mounted in the container of the base. The LED module is mounted on the mounting surface of the container in the base, is covered by the hood and emits light beams at various angles. The light gathering element is mounted on the LED module to reflect light beams not emitted directly to the inner surface of the hood to ensure a greater percentage of light is reflected by the reflective surface to increase brightness of the LED lighting device.

16 Claims, 3 Drawing Sheets

LIGHT EMITTING DIODE LIGHTING DEVICE HAVING A LENS CONNECTED TO A HOOD

BACKGROUND OF THE INVENTION

1. Field of the Invention

The present invention relates to a lighting device, and more particularly to a light emitting diode lighting device that achieves greater convergence of light beams.

2. Description of Related Art

Traditional light bulbs are tungsten light bulbs for light emitting sources for conventional lighting devices. However, light emitting diodes (LEDs) are replacing traditional bulbs in many applications for lighting devices, such as headlights, fog lights, turn-signal lights, brake lights or the like, because LEDs have longer useful lives, require less electricity than tungsten light bulbs and have faster reaction times.

Conventional LED headlights comprise reflector headlights and projector headlights.

A conventional reflector headlight comprises a reflector and an LED. The reflector has a reflecting front. The reflecting front is parabolic-shaped. The LED is mounted on the center of the reflecting front of the reflector so some of the light beams emitted by the LED will be reflected from the conventional reflector headlight.

A conventional projector headlight comprises a reflector, a base and an LED. The reflector has a reflecting front. The reflecting front is parabolic-shaped. The base is mounted horizontally in and covered by the reflecting front of the reflector. The LED is mounted on the base so some of the light beams emitted by the LED will be reflected from the conventional projector headlight.

However, an incident angle of each light beam is different from the incident angles of other light beams, and further, different incident angles of the light beams result in different reflecting angles of the reflected light beams based on the laws of reflection. Accordingly, light beams reflected from the conventional reflector headlights and projector headlights are scattered. Consequently, the scattered light beams ineffectively visible at greater distance.

A solution for resolving the short radiation distance of the conventional reflector headlights and projector headlights is xenon headlights. The xenon headlights are brighter, and light beams emitted by the xenon headlights have a longer radiation distance than the radiation distance of the light beams emitted from the conventional reflector headlights and projector headlights. However, the xenon headlights are larger than the conventional reflector headlights and projector headlights.

To overcome the shortcomings, the present invention provides a light emitting diode lighting device that achieves greater convergence of light beams to mitigate or obviate the aforementioned problems.

SUMMARY OF THE INVENTION

The main objective of the invention is to provide a light emitting diode (LED) lighting device that achieves greater convergence of light beams.

An LED lighting device in accordance with the present invention comprises a base, a hood, an LED module, a light gathering element and a lens. The base has a container having an inner bottom. The inner bottom comprises a parallel surface and a mounting surface being connected to the parallel surface at an included angle. The hood has a reflective inner surface and is mounted in the container of the base. The LED module is mounted on the mounting surface of the container in the base, is covered by the hood and emits light beams at various angles. The light gathering element is mounted on the LED module to reflect light beams not emitted directly to the inner surface of the hood to ensure a greater percentage of light is reflected by the reflective surface to increase brightness of the LED lighting device.

Other objectives, advantages and novel features of the invention will become more apparent from the following detailed description when taken in conjunction with the accompanying drawings.

DETAILED DESCRIPTION OF PREFERRED EMBODIMENT

Figure 1:
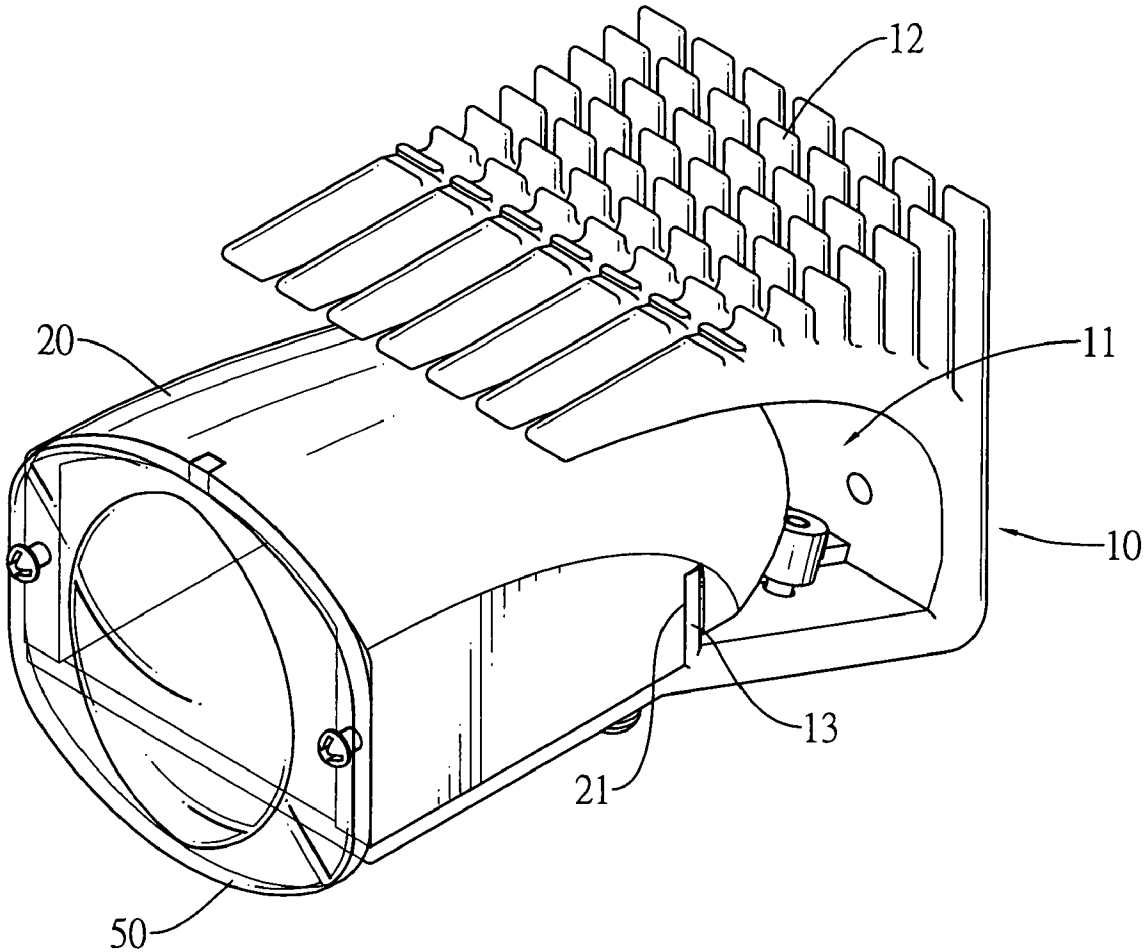
FIG. 1 is a perspective view of a lighting device in accordance of the present invention.
Figure 2:
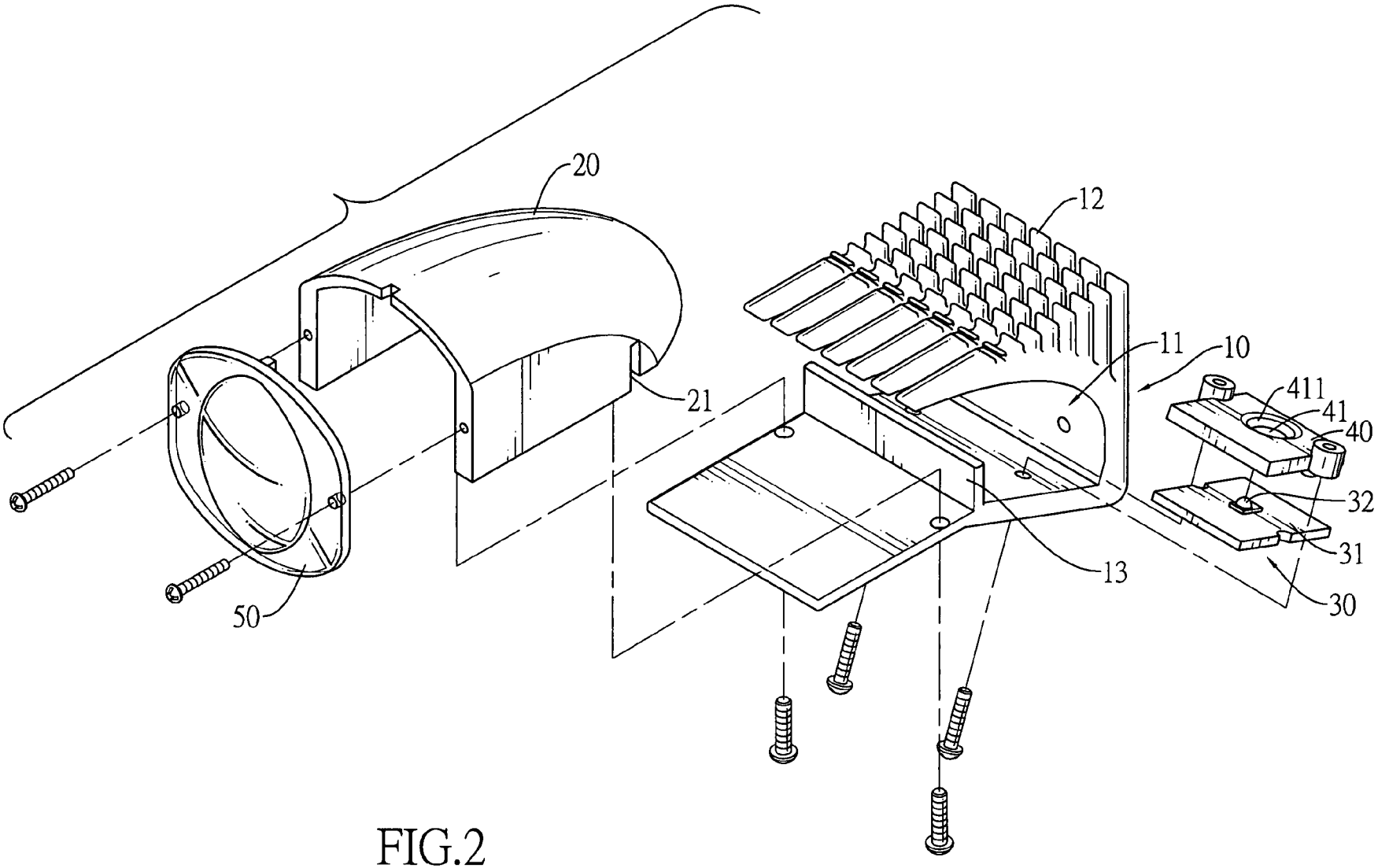
FIG. 2 is an exploded perspective view of the lighting device in FIG. 1.

With reference to FIGS. 1 and 2, a light emitting diode (LED) lighting device that achieves greater convergence of light beams in accordance with the present invention comprises a base (10), a hood (20), an LED module (30), a light gathering element (40) and a lens (50).

The base (10) has a top, multiple optional fins (12), a front opening, a container (11) and an optional retaining wall (13) and may be a material having high thermal conductivity. The top of the base (10) may be curved to correspond to a light mount, such as a light mount in a vehicle. The fins (12) are formed on the top of the base (10). The container (11) has an inner top and an inner bottom. The inner top of the container (11) may be curved to correspond to the top of the base (10). The inner bottom of the container (11) comprises a parallel surface and a mounting surface. The mounting surface connects to the inner top of the container (11). The parallel surface is disposed parallelly with a direction of light beam and protrudes from the mounting surface at an included angle. The included angle between the mounting surface and the parallel surface may be 20 degrees. The retaining wall (13) is formed perpendicularly on the parallel surface of the inner bottom adjacent to the mounting surface of the container (11).

The hood (20) has a reflective inner surface, is mounted securely in the container (11), covers the inner bottom of the base (10), may be curved to correspond to the inner top of the container (11), may be mounted using fasteners onto the parallel surface of the container (11) and may have two slots (21). The slots (21) correspond to and are mounted securely on the retaining wall (13) to ensure the hood (20) is held stably in the container (11).

The LED module (30) is mounted on the mounting surface of the inner bottom of the container (11), is covered by the hood (20) and comprises a circuit board (31) and at least one LED (32). The circuit board (31) is mounted on the mounting surface of the inner bottom of the container (11). The LED (32) is mounted on the circuit board (31) and emits multiple light beams at various angles, the light beams may be characterized as being: a first group of light beams, a second group of light beams and a third group of light beams.

The first group of light beams are emitted directly at the reflective inner surface of the hood (20) and are reflected through the front opening of the base (10) by the reflective inner surface of the hood (20).

Figure 3:
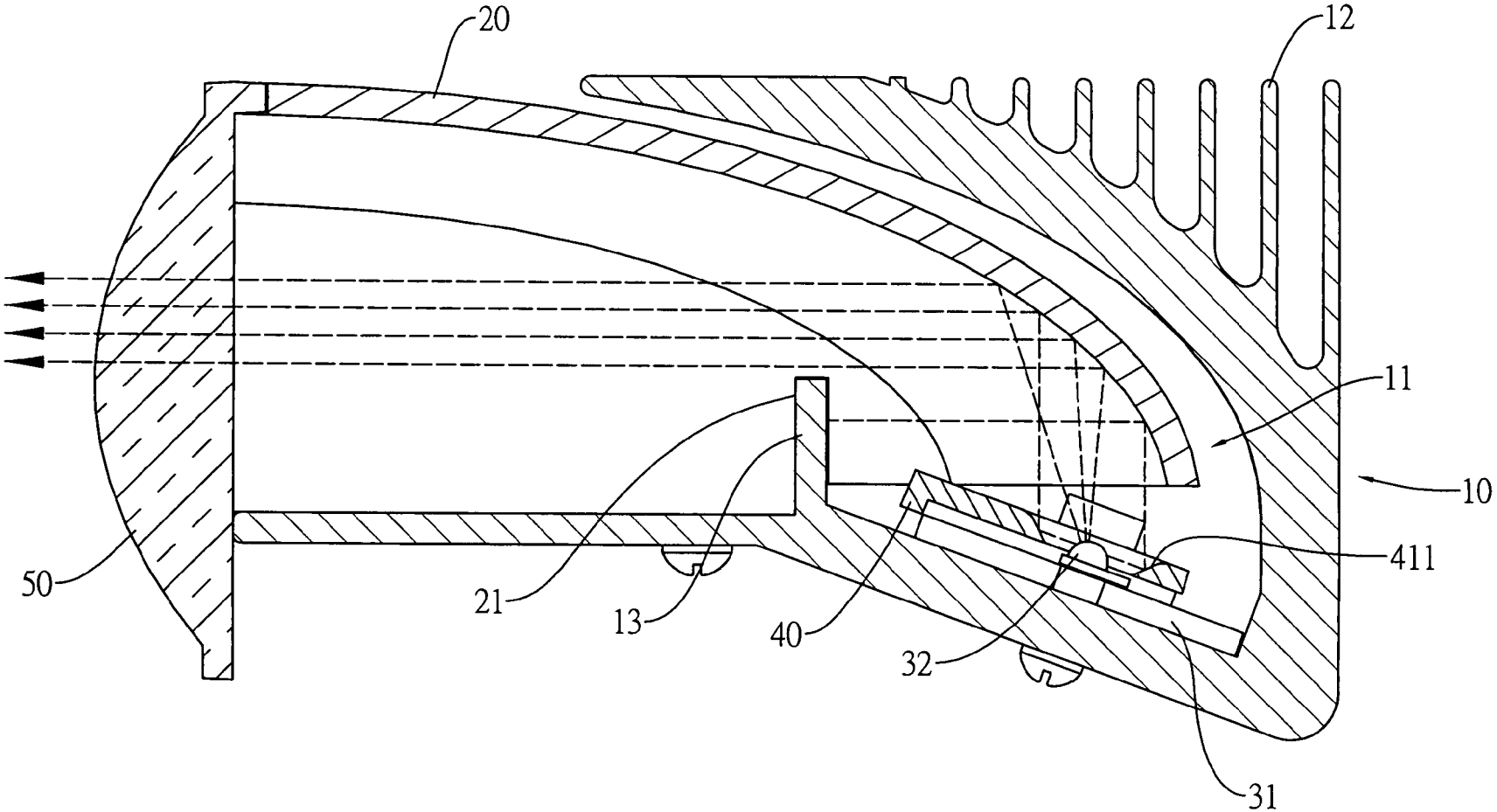
FIG. 3 is a side view in partial section of the lighting device in FIG. 1, showing of light beams being reflected in and emitted by the lighting device.

The light gathering element (40) is mounted on the LED module (30) and has at least one LED mount (41). Each LED mount (41) corresponds to one LED (32) to allow a corresponding LED (32) to be mounted through the LED mount (41) and has an inner edge and an inclined surface (411) formed around the inner edge of the LED mount (41). With further reference to FIG. 3, the inclined surface (411) reflects the second and third groups of light beams emitted by the LED (32) being light emitted by the LED substantially parallelly to the mounting surface of the inner bottom of the container (11). The inclined surface (411) reflects the second and third groups of light beams to the reflective inner surface of the hood (20) beside the first group of light beams so the second group of light beams once reflected are able pass out of the front opening of the base (10) with the first group of light beams. The third group of light beams are reflected against the retaining wall (13).

The lens (50) is connected to the hood (20), covers the front opening of the base (10) to allow the first and second group of light beams reflected by the reflective inner surface of the hood (20) to pass through and be focused, may be made of acrylic, may be curved, awl shaped, half oval shaped or half circle shaped and has diffusion capability to diffuse the light beams passed through the lens (50) to increase illuminating range of the LED lighting device.

From the foregoing description, the first and second groups of light beams emitting through the front opening of the base (10) are focused together because the second group of light beams are reflected at the reflective inner surface of the hood (20) beside the first group of light beams. Therefore, the LED lighting device in accordance with the present invention emits more focused light beams than conventional projector headlights and reflector headlights so the illuminating range of the LED lighting device of the present invention is longer than conventional LED lighting devices since more light beams are reflected through the lens. Moreover, the LED lighting device of the present invention is smaller than conventional xenon headlights because LEDs are still implemented.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light emitting diode lighting device comprising:

a base having a top;

a front opening; and a container having an inner top; and an inner bottom comprising a mounting surface connecting to the inner top of the container and a parallel surface being formed on and protruding at an included angle from the mounting surface;

a hood having a reflective inner surface, being mounted securely in the container and covering the inner bottom of the base;

a light emitting diode (LED) module being mounted on the mounting surface of the inner bottom of the container, being covered by the hood and comprising a circuit board being mounted on the mounting surface of the inner bottom of the container; and at least one LED being mounted on the circuit board, and each LED emitting multiple light beams at various angles, and part of the light beams being emitted directly at the reflective inner surface of the hood and being reflected through the front opening of the base by the reflective inner surface of the hood;

a light gathering element being mounted on the LED module and having at least one LED mount, each LED mount corresponding to one LED to allow a corresponding LED to be mounted through the LED mount and having an inner edge; and an inclined surface being formed around the inner edge of the LED mount to reflect the rest of the light beams emitted by the LED to the reflective inner surface of the hood beside the light beams emitted directly to the inner surface of the hood so light beams emitted indirectly to the inner surface of the hood are also the front opening of the base by the reflective inner surface of the hood; and a lens being connected to the hood, covering the front opening of the base to allow the light beams passing through the front opening of the base to pass through.

2. The lighting device as claimed in claim 1, wherein the top of the base is curved;

the base further has multiple fins formed on the top of the base and is composed by a material having high thermal conductivity; and the inner top of the container is curved and corresponds to the top of the base.

3. The lighting device as claimed in claim 1, wherein the hood is mounted using fasteners to the parallel surface of the container.

4. The lighting device as claimed in claim 2, wherein the hood is mounted using fasteners to the parallel surface of the container.

5. The lighting device as claimed in claim 1, wherein the base further has a retaining wall being formed perpendicularly from on the parallel surface of the inner bottom adjacent to the mounting surface of the container to retain part of the light beams reflected by the inclined surface of the LED mount and the inner surface of the hood; and the hood further has two slots being formed in the container, corresponding to and being mounted securely on the retaining wall.

6. The lighting device as claimed in claim 2, wherein the base further has a retaining wall being formed perpendicularly from on the parallel surface of the inner bottom adjacent to the mounting surface of the container to retain part of the light beams reflected by the inclined surface of the LED mount and the inner surface of the hood; and the hood further has two slots being formed in the container, corresponding to and being mounted securely on the retaining wall.

7. The lighting device as claimed in claim 1, wherein the lens is made of acrylic glass.

8. The lighting device as claimed in claim 7, wherein the lens is curved.

9. The lighting device as claimed in claim 1, wherein the included angle between the mounting surface and the parallel surface is 20 degrees.

10. The lighting device as claimed in claim 2, wherein the included angle between the mounting surface and the parallel surface is 20 degrees.

11. The lighting device as claimed in claim 3, wherein the included angle between the mounting surface and the parallel surface is 20 degrees.

12. The lighting device as claimed in claim 4, wherein the included angle between the mounting surface and the parallel surface is 20 degrees.

13. The lighting device as claimed in claim 5, wherein the included angle between the mounting surface and the parallel surface is 20 degrees.

14. The lighting device as claimed in claim 6, wherein the included angle between the mounting surface and the parallel surface is 20 degrees.

15. The lighting device as claimed in claim 7, wherein the included angle between the mounting surface and the parallel surface is 20 degrees.

16. The lighting device as claimed in claim 8, wherein the included angle between the mounting surface and the parallel surface is 20 degrees.

* * * * *